United States Patent [19]

Ohlhaber

[11] Patent Number: 4,801,764

[45] Date of Patent: Jan. 31, 1989

[54] CABLE ASSEMBLY FOR USE UNDER CARPETING

[75] Inventor: Ronald L. Ohlhaber, Geneva, Ill.

[73] Assignee: Cooper Industries, Inc., Houston, Tex.

[21] Appl. No.: 828,849

[22] Filed: Feb. 11, 1986

[51] Int. Cl.[4] ..... H01B 7/08; H01B 11/22

[52] U.S. Cl. ..... 174/70 C; 174/117 F; 350/96.23

[58] Field of Search ..... 174/70 C, 72 C, 117 F, 174/97; 350/96.23

[56] References Cited

U.S. PATENT DOCUMENTS

| | | | |
|---|---|---|---|
| 1,668,953 | 5/1928 | Erickson | 174/116 |
| 2,079,274 | 5/1937 | Baker | 174/117 F |
| 2,391,409 | 12/1945 | Geist et al. | 174/72 C |
| 2,595,452 | 5/1952 | Geist et al. | 174/95 |
| 2,636,520 | 4/1953 | Geist et al. | 174/70 C |
| 2,727,088 | 12/1955 | Wall | 174/135 |
| 2,963,676 | 12/1960 | Sneesby et al. | 174/70 C |
| 3,029,303 | 4/1962 | Severino | 174/70 C |
| 3,187,290 | 6/1965 | Winders | 174/72 C |
| 3,321,571 | 5/1967 | Lynch | 174/101 |
| 3,395,244 | 7/1968 | Koehler | 174/135 |
| 3,800,068 | 3/1974 | Torgerson | 174/135 |
| 3,887,265 | 6/1975 | Margolis et al. | 350/96.23 |
| 3,965,967 | 6/1976 | Jentzsch et al. | 174/70 C |
| 4,203,004 | 5/1980 | Cox | 174/135 |
| 4,258,515 | 3/1981 | Owen | 52/105 |
| 4,401,361 | 8/1985 | Slaughter | 350/96.23 |
| 4,404,425 | 9/1983 | Rich | 174/117 F |
| 4,419,538 | 12/1983 | Hansell, III | 174/117 F |
| 4,467,138 | 8/1984 | Brorein | 350/96.23 |
| 4,468,089 | 8/1984 | Brorein | 350/96.23 |
| 4,644,099 | 2/1987 | Basconi | 174/70 C |

FOREIGN PATENT DOCUMENTS

| | | | |
|---|---|---|---|
| 2016730 | 11/1970 | Fed. Rep. of Germany | 174/117 F |
| 1304739 | 8/1962 | France | 174/72 C |
| 0095905 | 7/1980 | Japan | 350/96.23 |
| 0154221 | 8/1985 | Japan | 350/96.23 |

*Primary Examiner*—Charles T. Jordan
*Assistant Examiner*—Richard W. Wendtland
*Attorney, Agent, or Firm*—Fitch, Even, Tabin & Flannery

[57] ABSTRACT

A thin, relatively flat cable assembly for laying under carpet. The cable assembly includes an insulative central region and at least one conductor held in the central region. The conductor is of the type able to undergo only limited bending without damage, such as an optical fiber or a coaxial cable. The cable assembly also includes a pair of insulative side portions connected to the central region and extending therefrom in opposite directions with the side portions and the central region forming a substantially flat bottom surface of the cable assembly. Each of the side portions has components for permitting only limited bending of the cable assembly in the plane of the bottom surface.

2 Claims, 3 Drawing Sheets

CABLE ASSEMBLY FOR USE UNDER CARPETING

The present invention relates to cable assemblies and, more particularly, to a thin, substantially flat cable assembly for under carpet use and including a conductor, such as an optical fiber or a coaxial cable, which can undergo only limited bending without being damaged.

BACKGROUND OF THE INVENTION

One particularly efficient and economical way to route electrical conductors is through the use of a ribbon cable, having a number of spaced parallel electrical conductors held in a thin, flexible layer of insulation, laid under carpeting in, for example, office areas. A change in direction in such a flat cable is achieved by sharply folding the cable upon itself so that stacked layers of the cable result at the bend. While such a method of changing direction can be employed with a ribbon cable having spaced copper wires which can undergo an immediate 90 or 180 degree bend, this method of changing direction is not suitable with a cable assembly including an optical fiber or a coaxial cable. Sharp bending of an optical fiber will result in light attenuation while folding an optical fiber on itself will cause it to break. Folding of a coaxial cable will mechanically damage the shield, displace the dielectric between the conductor and shield, and cause a change in the impedance characteristics of the cable.

One recently-proposed coaxial cable assembly for use under carpeting includes a jacket of polyvinyl chloride (PVC) having a central portion, holding a small coaxial cable, and side portions each having a stress-bearing member of nylon. The stress-bearing members, which are relatively inelastic, are independently longitudinally movable in the jacket. Bending of the cable assembly causes the member at the inside of the bend to extend beyond the jacket while the member at the outside of the bend is drawn inside the jacket. As the stress-bearing members must move throughout the length of the cable assembly, the force required to form the bend is a function of the length of the cable assembly. For further information regarding the structure and operation of such a cable assembly, reference may be made to U.S. Pat. No. 4,419,538.

SUMMARY OF THE INVENTION

Among the several aspects and features of the present invention may be noted the provision of an improved under-carpet cable assembly which can include either one or more optical fibers and/or a small coaxial cable. The cable assembly is thin and relatively flat, and limits bending in the plane of the cable assembly so that the signal conductor will function properly and will be protected from mechanical damage. In certain embodiments, the cable can be readily separated from remaining components of the assembly. The cable assembly of the present invention is unobtrusive when installed under carpeting and can support normal loads without functional or mechanical damage to the signal conductor. Furthermore, the cable assembly is reliable in use, has long service life, is lightweight and is easy and economical to manufacture. Other aspects and objects will be in part apparent and in part pointed out hereinafter in the following specification and accompanying drawings.

Briefly, the cable assembly of the present invention includes an insulative central region with a pair of insulative side portions connected to the central region and extending in opposite directions therefrom. At least one conductor of the type able to undergo only limited bending without damage is held in the central region. The central region and side portions form a substantially flat bottom surface of the cable assembly and each of the side portions has components for limiting bending of the cable assembly in the plane of the bottom surface.

DESCRIPTION OF THE PREFERRED EMBODIMENTS

Figure 1:
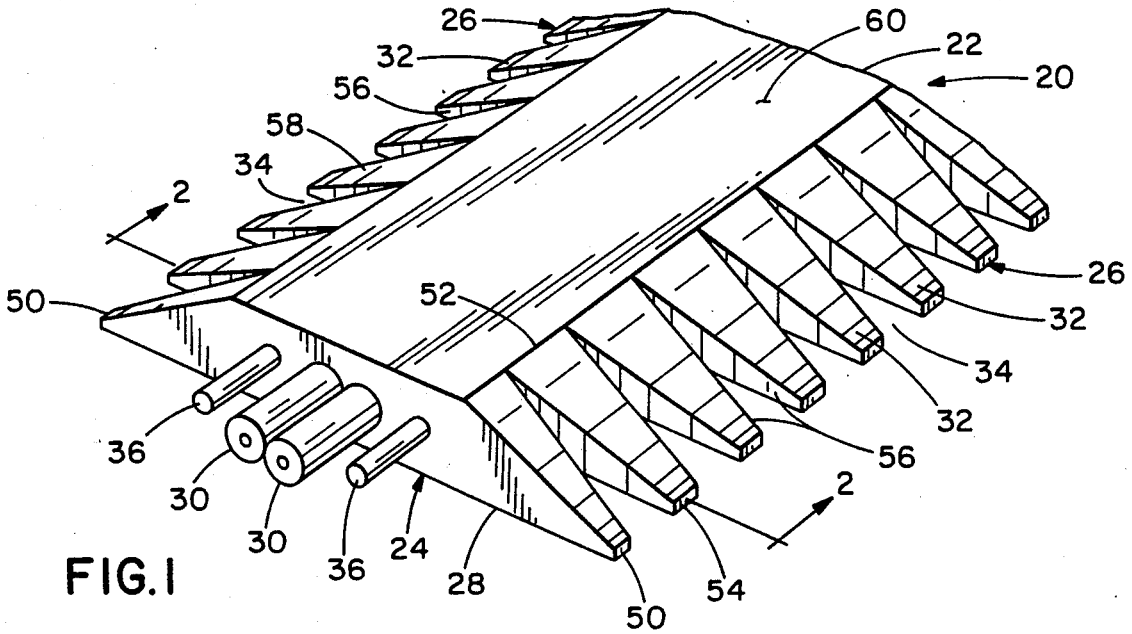
FIG. 1 is a perspective view of an under-carpet cable assembly having a central region holding an optical fiber and side portions made up of spaced fingers, embodying various aspects of the present invention.
Figure 2:
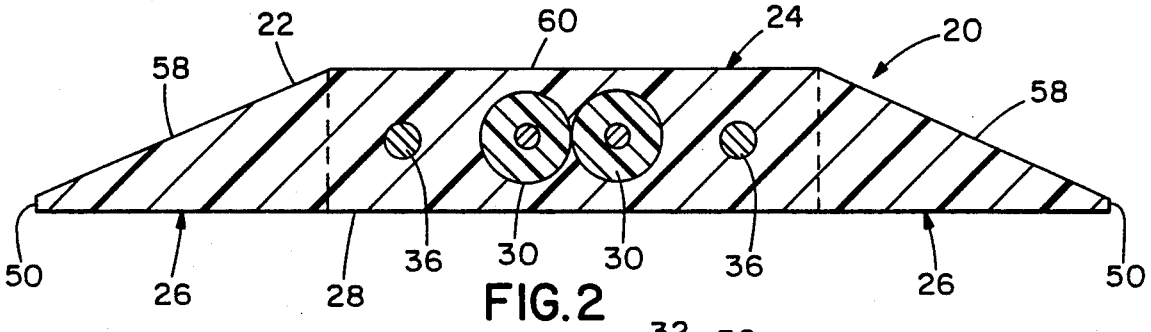
FIG. 2 is a cross-sectional view of the cable assembly of FIG. 1.
Figure 3:
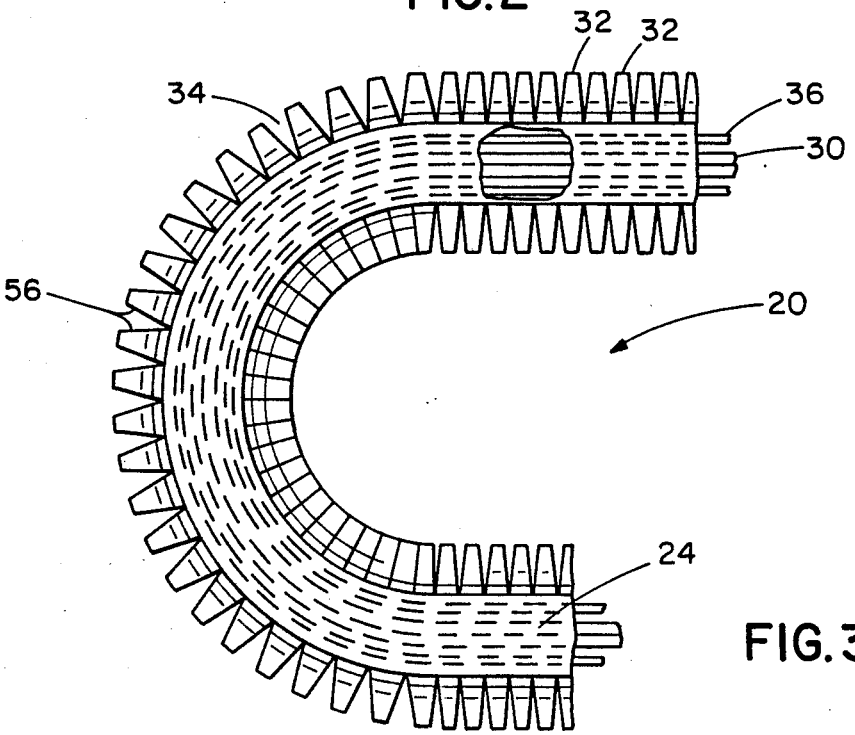
FIG. 3 is a plan of the cable assembly of FIG. 1 shown bent in the plane of the assembly with adjacent fingers on the side portion on the inside of the bend engaging each other to limit bending so that the optical fiber will not be damaged.

Referring now to the drawings, a cable assembly embodying various features of the present invention is generally indicated by reference numeral 20 in FIGS. 1–3. The cable assembly is thin and relatively flat, and includes an insulative covering or jacket 22 which has an elevated central region 24 and a pair of wedge-shaped side portions 26 extending in opposite directions from the central region with the side portions and the central region forming a substantially flat bottom surface 28 of the cable assembly 20. The central region holds at least one conductor 30, such as an optical fiber assembly, which is able to undergo only limited bending so that functional and/or mechanical damage to the conductor is avoided. Each of the side portions 26 has means for permitting limited bending of the cable assembly 20 in the plane of the bottom surface 28, as is necessary for the assembly to make a turn under the carpeting. Each side portion includes a plurality of regularly spaced fingers 32 extending normal to the axial direction of the cable assembly, with each adjacent pair of fingers 32 defining a space 34, as shown in FIG. 1. Referring to FIG. 3, bending of the cable assembly in the plane of the bottom surface 28 is substantially limited by engagement of adjacent fingers on the side portion located at the inside of the bend.

The conductor 30 can be a conductor of electromagnetic radiation, such as light, an example of which is an optical fiber assembly. A typical fiber assembly has a glass fiber center for transmitting light, a glass cladding for reflecting light back into the glass fiber center, and an ultraviolet cured acrylate sleeve, applied at the time of manufacture of the glass and cladding, for mechanical protection of the glass. Flanking the conductor 30 in the central region are a pair of strength members 36 which have limited elasticity to permit formation of a bend, but which are sufficiently rigid to protect the conductor 30 from crushing due to personnel walking on the cable assembly or equipment being moved over the cable assembly. Additionally, the strength members 36 serve to take the pulling forces to resist elongation of the conductor 30 when the cable assembly is pulled from a reel during installation of the assembly. Preferred materials for the strength members are Kevlar synthetic strength fiber (Kevlar is a registered trademark of DuPont), copper or fiberglass.

Figure 4:
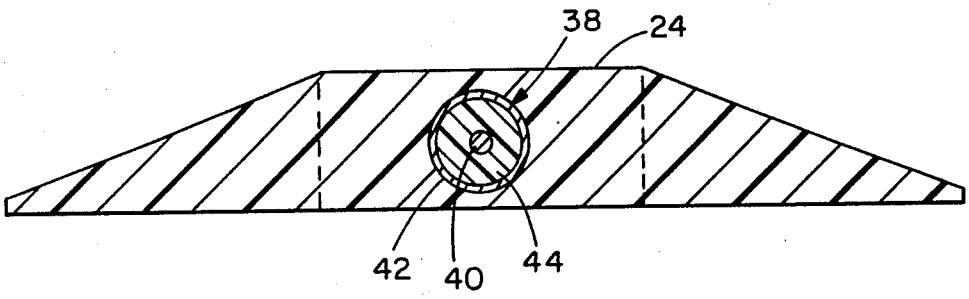
FIG. 4, similar to FIG. 2, illustrates an alternative embodiment of the cable assembly of the present invention in which the central region holds a small coaxial cable.

Referring to FIG. 4, the central region 24 could also hold a small coaxial cable 38 having a central conductor or core 40, a coaxial shield 42 and a tubular layer of a dielectric material 44 disposed between the core 40 and the shield 42. The shield 42 could be a cylindrical metallic wall. Alternatively, the shield could be formed of a metallic braid and a layer of metallic foil can be disposed under the braid and in contact therewith. The use of the braid over the foil results in the lowest radio frequency leakage and lowest susceptibility to electrical noise. The braid functions to limit penetration of low frequency noise while the presence of the foil limits high frequency noise penetration.

Figure 5:
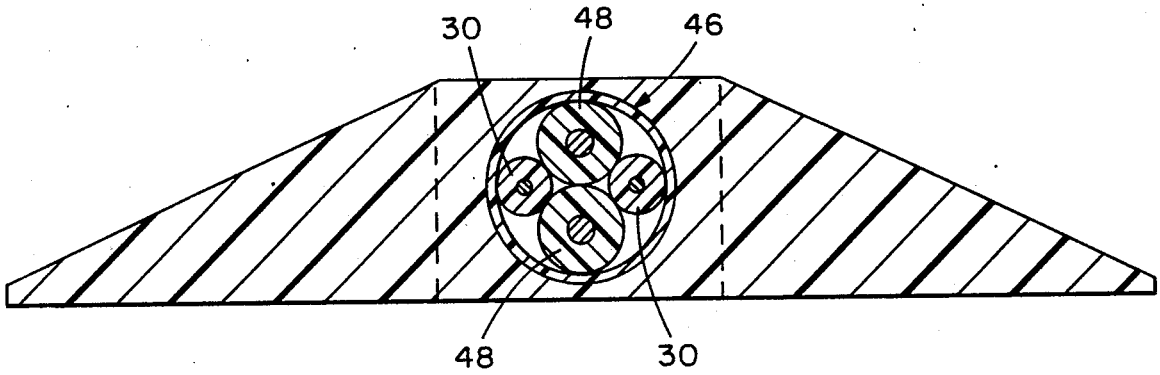
FIG. 5, also similar to FIG. 2, illustrates another alternative embodiment of the cable assembly in which the central region holds a fiber optic cable.

As shown in FIG. 5, the optical conductor 30 could be part of a fiber optic cable 46 which, for example, includes a pair of fiber assemblies 30 cabled with a pair of strength members 48 so that the fiber assemblies are cradled by the strength members to protect the former from impact and crushing forces. Such a fiber optic cable is disclosed in commonly-assigned U.S. Pat. No. 4,552,432, the teachings of which are hereby incorporated by reference. If a fiber optic cable incorporating a strength member is used, the provision of the stradling strength members 36 would not be necessary.

More specifically, cable assembly 20 has lateral edges 50 and each finger 32 has an inner end 52 connected to the central region 24 and a distal end 54 extending to a lateral edge 50 of the cable assembly. Each finger 32 has side surfaces 56 extending from the inner finger end 52 to the distal finger end 54, with facing side surfaces of adjacent finers defining each of the spaces 34. In the embodiment of the cable assembly shown in FIGS. 1–3, these planar side surfaces intersect at the central region 24 and diverge outwardly therefrom. The angle of divergence determines the distance between the distal ends of adjacent fingers which in turn determines the extent of bending permitted (degrees per unit length). The minimum safe bending is, of course, determined by the structure of the conductor held in the central region 24.

Each side portion has an angled top surface 58 converging with the bottom surface 28 away from the central region. Furthermore, the central region 24 has a crest surface 60 extending substantially parallel to the bottom surface 28 and joining the top surfaces 58 of the side portions 26. The side portions with their sloping top surfaces function as ramps to the elevated central region so that, for example, wheeled carts can easily be moved over the cable assembly as they do not encounter an abrupt step. The gradual elevation provided by the side portions also makes the cable assembly less obtrusive to personnel. Preferred extrudable materials for the jacket 22 which offer flexibility with a degree of strength are PVC, polyethylene and various fluorocarbon plastics, which have low flame propagation characteristics.

Figure 6:
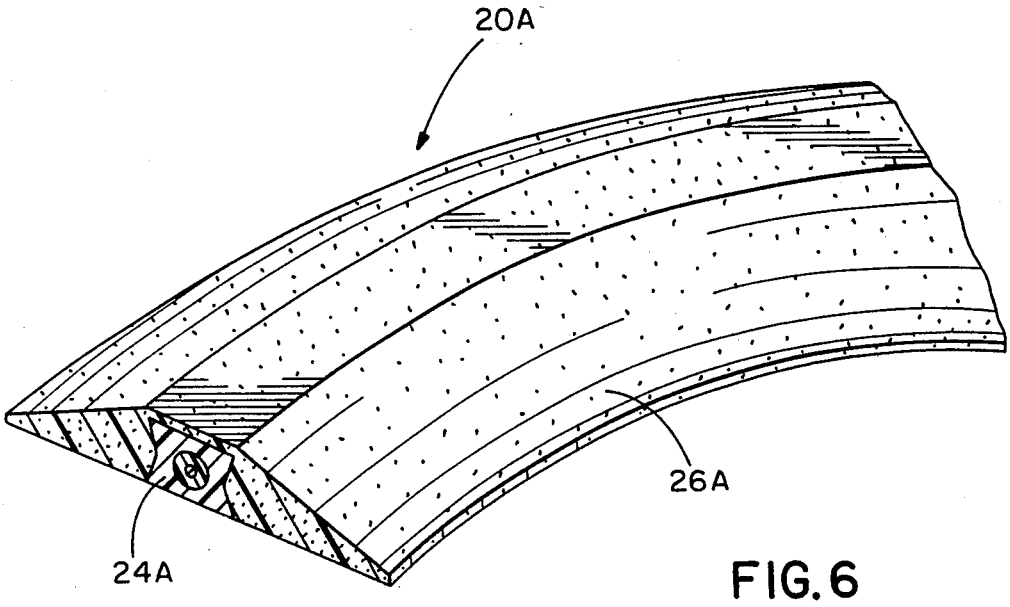
FIG. 6 is a perspective view of another alternative embodiment of the cable assembly wherein the side portions are formed of a foamed plastic and have a generally uniform cross section throughout the length of the cable assembly.

Referring to FIG. 6, an alternative embodiment 20A of the cable assembly of the present invention is shown. Components of assembly 20A corresponding to those of cable assembly 20 are indicated by the reference character applied to the component of assembly 20 with the addition of the suffix "A". In the cable assembly 20A, the side portions 26A are formed of a foamed plastic material, while the central region 24A is made of a relatively rigid plastic material such as those discussed above with respect to jacket 22. A preferred foamed plastic material is polypropylene which can be extruded over the central region 24A. With the side portions 26A of foamed material, it is unnecessary to provide spaces between the fingers. The material of the central region provides some flexibility and the foam side portions exhibit greater resistance to bending as a function of the degree of bending. Thus, the desired feature of limited bending is also achieved.

Figure 7:
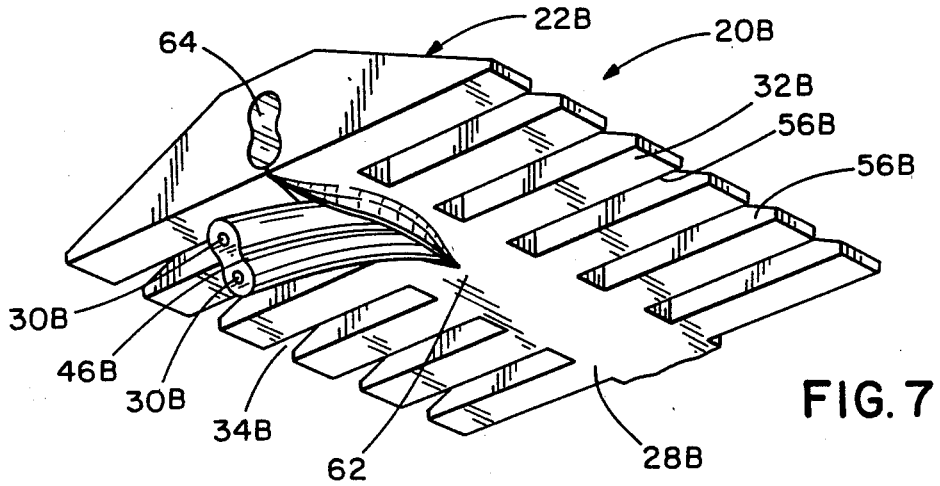
FIG. 7 is a perspective view of another alternative embodiment of the cable assembly of the present invention wherein the central region includes a thin, rupturable membrane underlying the cable so that the cable can be conveniently separated from the remainder of the cable assembly.

Another alternative embodiment 20B of the cable assembly is shown in FIG. 7 with components of assembly 20B corresponding to those of cable assembly 20 designated by the reference character applied to the component of assembly 20 with the addition of the suffix "B". In the cable assembly 20B, the fingers 32B have facing side surfaces 56B which are parallel to each other. This provides the advantage that each space 34B or slot can be formed with a single cut by a saw blade. The engagement of the distal ends of the fingers again substantially limits bending of the cable assembly to a safe degree to protect the conductors 30. As shown in FIG. 7, a duplex cable 46B could be used wherein spaced conductors 30B are held in an insulative web. Additionally, the central region 24B is extruded with a thin rupturable membrane 62 underlying the duplex cable 46B. By pulling the cable 46B, the cable can be separated from the remainder of the cable assembly (jacket 22B) which promotes ease of termination of the signal conductors. As with previous embodiments, the cable assembly 20B can be easily bent in the plane of the bottom surface 28B while remaining flat on the floor prior to the laying of the carpeting.

Figure 8:
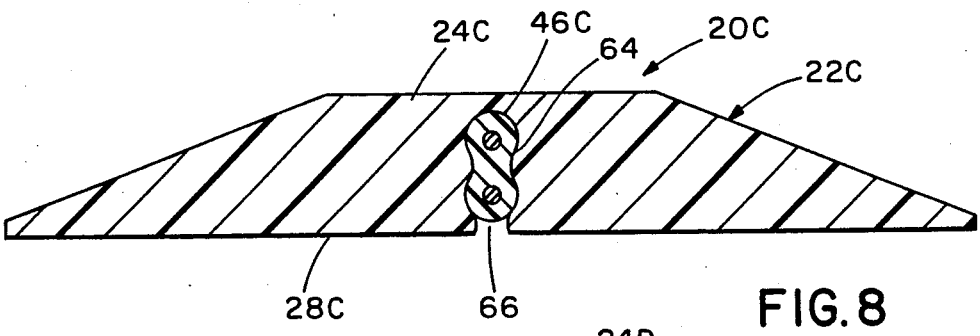
FIG. 8 illustrates another alternative embodiment of the cable assembly wherein the central region has a cavity opening onto the bottom surface for receiving the cable.

Another alternative embodiment of the cable assembly of the present invention is shown by reference character 20C in FIG. 8. Cable assembly 20C is, in essence, of two-piece construction wherein the jacket 22C is of integral construction. The central region 24C has a cavity 64 with a constricted throat 66 opening onto the bottom surface 28C. The constricted throat 66 is sized to receive the cable 46C to be held in an interference fit so that by pushing the cable 46C into the cavity 64, the cable moves past the throat and is held in the cavity. One advantage of this configuration is ease of separation of the cable from the jacket 22C when it is desired to terminate the conductors in the cable.

Figure 9:
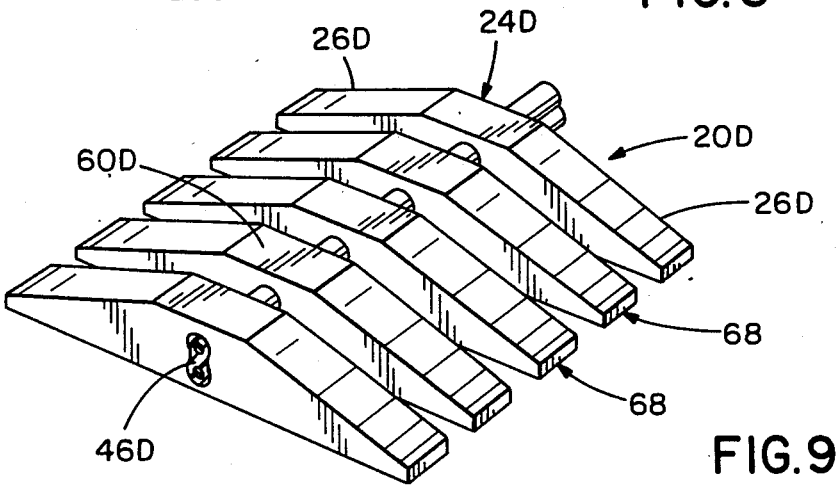
FIG. 9 is a perspective view of yet another alternative embodiment of the cable assembly wherein the cable holds a plurality of spaced, discrete ridge elements.
Figure 10:
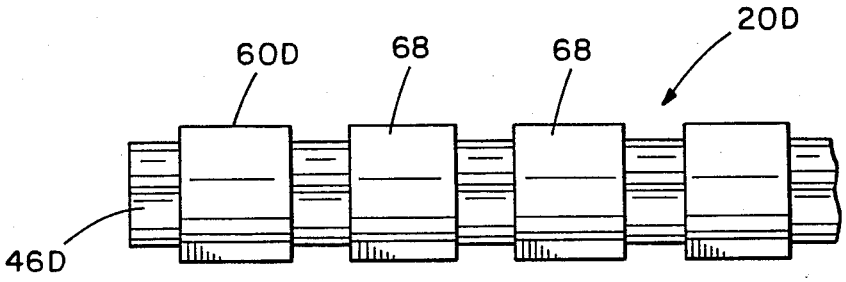
FIG. 10 is a side view of the cable of FIG. 9. Corresponding reference characters indicate corresponding components throughout the several views of the drawings.

Another alternative embodiment of the cable assembly is shown by reference character 20D in FIGS. 9 and 10. In this embodiment, the protective jacket is formed by a plurality of regularly spaced discrete ridge elements 68 held by the fiber optic cable 46D. Each of the ridge elements 68 has a central region 24D and wedge-shaped sized portions 26D extending therefrom. The protective ridge elements can be of the "snap-on" configuration of the type shown in FIG. 8, or the ridge elements could be sequentially molded to the fiber optic cable. In either event, the spacing between adjacent ridge elements 68 dictates the extent of bending of the cable to limit the bending so that the fiber optic cable will not be functionally or mechanically damaged.

The undercarpet cable assembly of the present invention permits formation of a bend or turn without the requirement of folding the cable assembly upon itself as is known in the prior art with respect to flat cables having only spaced, parallel copper electrical conductors.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A thin, relatively flat cable assembly for laying under carpet, said cable assembly comprising:

an insulative central portion formed of a relatively rigid plastic material;

at least one conductor held in said central portion and having an insulative jacket; and a pair of insulative side portions formed of a foamed plastic material connected to said central portion and extending in opposite directions from said central portion with said side portions and said central portion forming a substantially flat bottom surface of said cable assembly, said central portion providing crush protection for said conductor and said side portions providing limited bending of said assembly in the plane of said bottom surface.

2. A thin, relatively flat cable assembly for laying under carpet, said cable assembly comprising:

a cable comprising at least one conductor having an insulative jacket; and a plurality of regularly, axially spaced, discrete ridge elements held only by said cable, each element being of a plastic and formed by molding and including an element central region and a pair of side portions connected to said central region and extending in opposite directions therefrom with the side portions and the central region forming a substantially flat bottom surface, the bottom surfaces of said elements being substantially coplanar and forming a bottom surface of said cable, adjacent side portions of adjacent elements defining spaces when said cable assembly is not bent in the plane of said cable bottom surface bending of said cable assembly in the plane of said bottom surface being substantially limited by contact of the distal ends of adjacent side portions on the inside of the bend so that the spaces at the lateral edge on the inside of the bend are substantially closed.

* * * * *